United States Patent [19]

Pray

[11] 3,946,545

[45] Mar. 30, 1976

[54] SPINDLE MOUNTING MEANS FOR TEXTILE TWISTING MACHINE

[75] Inventor: Lester W. Pray, Clemson, S.C.

[73] Assignee: Platt Saco Lowell Corporation, Greenville, S.C.

[22] Filed: Apr. 22, 1975

[21] Appl. No.: 570,547

[52] U.S. Cl. ..... 57/1 R; 57/136; 248/22

[51] Int. Cl.[2] ..... D01H 7/10; D01H 1/14

[58] Field of Search ..... 57/1 R, 34 R, 75, 104, 57/105, 135, 136, 137, 129, 130; 248/20, 22

[56] References Cited

UNITED STATES PATENTS

| | | | |
|---|---|---|---|
| 2,615,297 | 10/1952 | Haythornthwaite | 57/1 R |
| 2,690,641 | 10/1954 | Keyser | 57/1 R |
| 2,758,439 | 8/1956 | Bradshaw | 57/136 |
| 3,604,191 | 9/1971 | Jaeggli | 57/1 R |

FOREIGN PATENTS OR APPLICATIONS

| | | | |
|---|---|---|---|
| 1,013,556 | 12/1965 | United Kingdom | 57/1 R |

*Primary Examiner*—John Petrakes
*Attorney, Agent, or Firm*—Joseph H. Heard

[57] ABSTRACT

Spindle units adjacent each side of a textile twisting machine are mounted, for noise abatement purposes, in vibration insulated relationship to the frame of the machine, to all spindle units adjacent the other side of the machine, and preferably also to other spindle units adjacent the same side of the machine. The spindle units are so mounted by a plurality of rigidly constructed but resiliently supported mounting assemblies. Each assembly includes an elongate spindle supporting member extending longitudinally of the twisting machine adjacent one or the other side thereof, and at least one transverse stabilizing member extending laterally inwardly therefrom toward, but terminating short of, the opposite side of the machine.

20 Claims, 13 Drawing Figures

SPINDLE MOUNTING MEANS FOR TEXTILE TWISTING MACHINE

BACKGROUND OF THE INVENTION

This invention relates to a textile spinning and/or twisting machines of the type having rows of spindle units adjacent opposite sides thereof, and is more particularly directed to abatement of the noise which tends to be generated during operation of such machines by vibrations emanating from their spindle units.

During operation of textile machines of the aforesaid type, which for convenience will hereinafter be generically referred to as twisting machines, vibrations are produced at the individual spindle units by the rapid rotative movement which the spindle, bearing and/or other components of such units then undergo. When these vibrations are transmitted from the spindle units to other components of the twisting machine, the noise produced by the other components is frequently greater than that emanating from the spindle units themselves. U.S. Pat. No. 3,604,191 recognizes the foregoing problem, and discloses a spindle mounting arrangement whereby the spindle units of a twisting machine are mounted upon a ladder-like structure, having longitudinal members extending substantially the full length of the machine adjacent opposite sides thereof and having a plurality of cross members extending across the full width of the machine and rigidly interconnecting the longitudinal members, which is connected by blocks or pads of resilient vibration-damping material to the machine's frame. Such arrangement lessens the transmission of vibration from the spindle units to the frame components of the twisting machine, and therefore achieves a degree of noise reduction. The thus-realized noise reduction may be significantly offset, however, by the noise produced by the vibrations induced in the ladder-like spindle mounting structure itself. The rigid, essentially-unitary construction of such structure permits the transmission of vibrations from each spindle unit throughout substantially the entire length of the twisting machine along both sides thereof, and throughout the entire width of the machine at a plurality of longitudinally-spaced locations. Even when the vibrations produced by each spindle unit are of a routine nature, the transmission of them through such an extensive system of rigidly interconnected longitudinal and cross members is not desirable from a noise abatement viewpoint. And if the vibrations produced by a spindle unit should be of a type particularly undesirable from such viewpoint, as could be the case due to bearing wear or the like at the unit in question, localization of them is even more desirable. In addition to the fact that the vibrations of each spindle unit are transmitted to and along an extensive path of travel, the vibrations of all the spindle units are transmitted to and along the same, common path of travel. This raises the possibility of the vibrations emanating from each spindle unit being reinforced by the vibrations produced by any one or more of the many other spindle units, even one located at the opposite end and on the opposite side of the machine. Resonance is also more difficult to avoid when a unitary mounting structure is employed. Modification of, for example, the cross-sectional shape of one component of the structure, for the purpose of eliminating a resonance condition thereat, may produce that same condition in other of the structure's components, due to the rigid interconnection therebetween. Additionally, since the lengths of the components of the unitary mounting structure are determined by the length and width of the twisting machine with which the structure is associated, the avoidance of resonance condition by lengthening or shortening individual components is not possible.

OBJECTS OF THE INVENTION

The primary object of the invention is the provision in a textile twisting machine of improved spindle mounting means which provides greater abatement of the noise heretofore generated by vibrations emanating from the spindle units of the machine during operation thereof.

Related and more specific objects of the invention are the provision of spindle mounting means comprising a plurality of spindle mounting assemblies, each mounting a group of the spindle units adjacent one or the other sides of the twisting machine in vibration-insulated relationship not only to the machine's frame, but also in vibration-insulated relationship to other of the spindle units and to the mounting assemblies therefor; and wherein each mounting assembly may be and preferably is so constructed as to avoid resonance conditions therein and so as to lessen the extent to which vibrations emanating from the spindle units may be transmitted therefrom.

SUMMARY OF THE INVENTION

The improved spindle mounting means of the present invention includes a plurality of rigidly constructed but resiliently supported mounting assemblies, each of which mounts a group of the spindle units adjacent one or the other sides of the textile twisting machine in vibration insulated relationship to the frame of the machine, to the other spindle units, and to the other of the mounting assemblies. Each assembly includes a spindle supporting member extending longitudinally along that side of the twisting machine adjacent the group of spindle units which it mounts, and further includes at least one stabilizing member connected to such longitudinal member and extending transversely therefrom toward the opposite side of the machine. The length of the transverse stabilizing member need not be and is not as great as the width of the frame of the machine, and the lengths of the transverse stabilizing and/or longitudinal members of each assembly may be and preferably are selected as to avoid resonance conditions in the assembly and to afford only a restricted path of travel for vibrations transmitted from the group of spindle units mounted by the assembly.

DESCRIPTION OF THE DRAWINGS

Other features of the invention will be pointed out hereinafter in the following description of preferred embodimemts thereof, which should be read in conjunction with the accompanying drawings, in which.

DESCRIPTION OF THE ILLUSTRATIVE EMBODIMENTS

Figure 1:
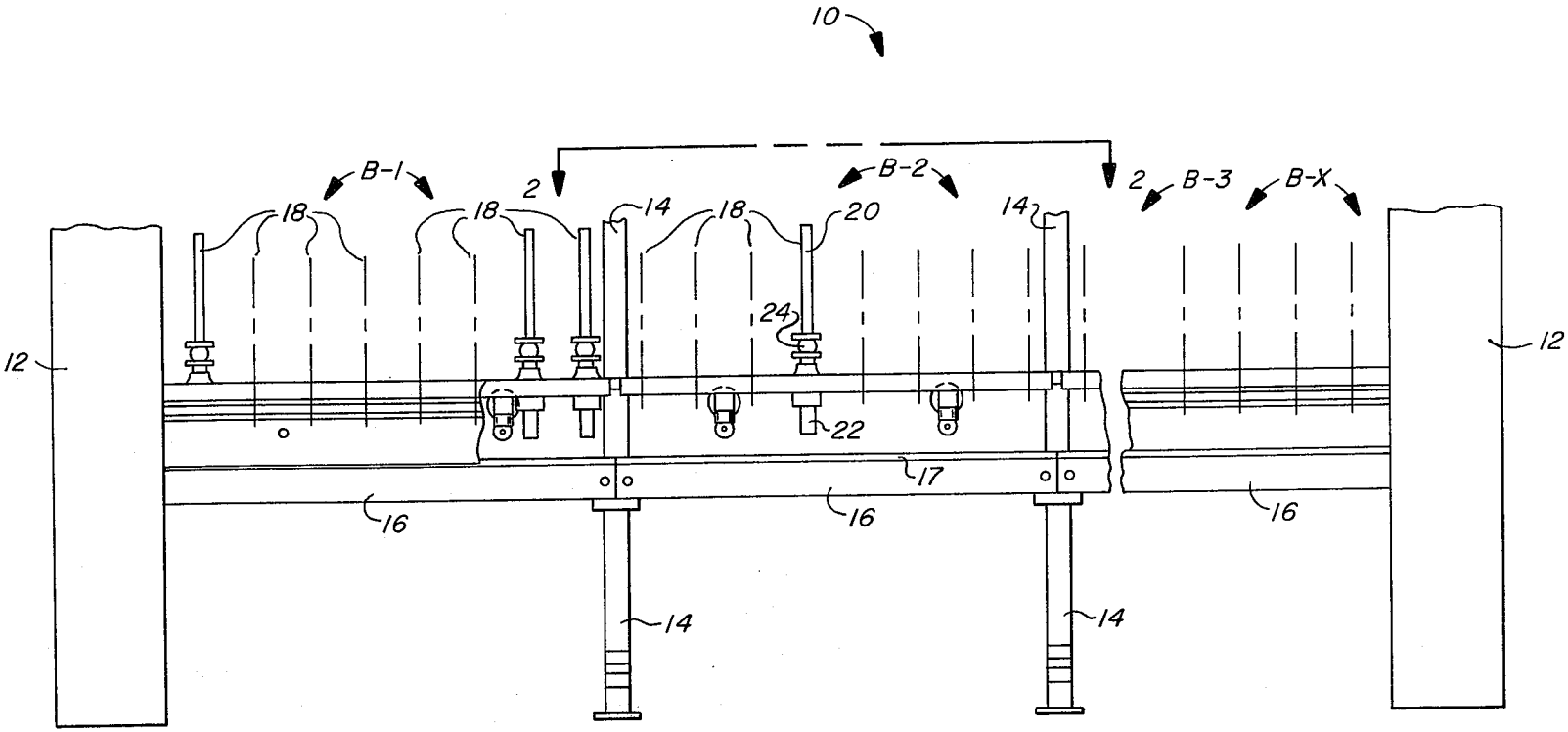
FIG. 1 is a fragmentary side elevational view of the lower portion of a textile twisting machine, broken away intermediate its length and with some components schematically shown, incorporating spindle mounting means in accordance with the invention.
Figure 2:
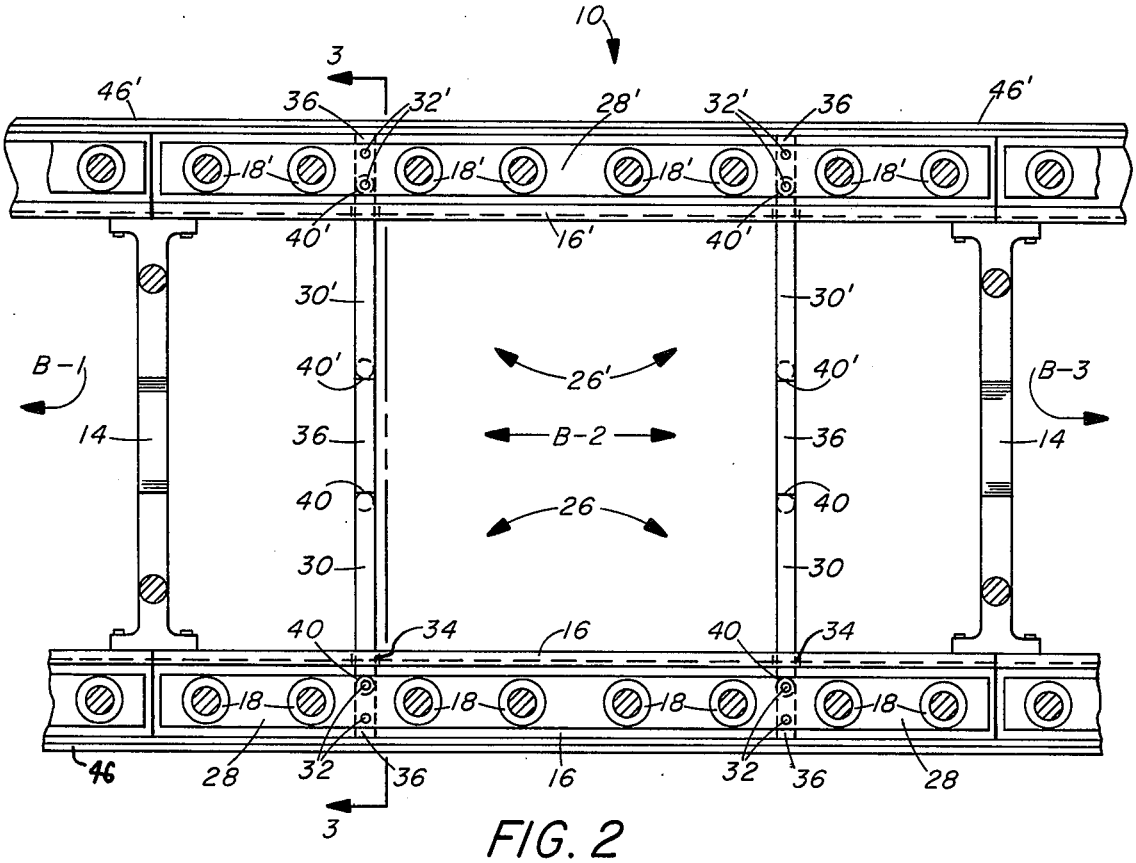
FIG. 2 is an enlarged fragmentary plan view of a portion of the machine as viewed in the direction of the arrows 2—2 of FIG. 1.
Figure 3:
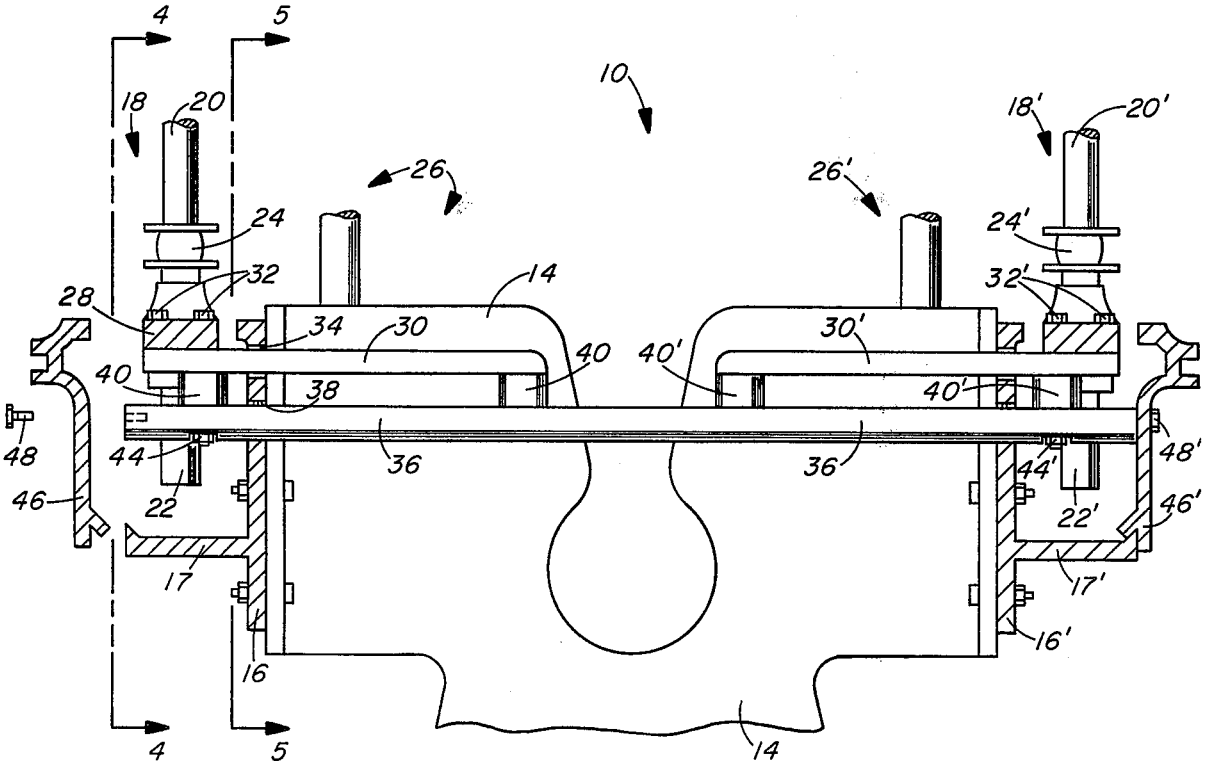
FIG. 3 is an enlarged vertical section, taken approximately along the lines 3—3 of FIG. 2 through the width of the machine, with some components shown in elevation and with other components shown in exploded relationship.

In FIGS. 1–3 the numeral 10 designates a textile twisting machine or the like having an elongate frame which includes end frame members in the form of end cabinets 12, intermediate frame members in the form of upstanding samsons 14, and interconnecting side frame members in the form of elongate, horizontally extending rails 16,16′. Although only two samsons 14 are shown in the drawings, additional ones would be provided at spaced intervals along the unillustrated remaining portion of the length of machine 10, and rails 16,16′ would be bolted or otherwise suitably secured to opposite sides thereof. Each rail 16,16′ may either be of a unitary construction, or may (as shown) be formed of aligned sections each having its opposite ends bolted or otherwise secured to an end or intermediate frame member 12,14.

Extending in two rows adjacent opposite sides and along substantially the entire length of machine 10 are a plurality of spindle units 18,18′, only a limited number of which are actually shown in the drawings. Units 18,18′ may be and each illustratively are of a conventional construction, each respectively including a blade or spindle component 20,20′ a base or bolster component 22,22′ and a whirl component 24,24′. During operation of machine 10, rotation is imparted to spindles 20,20′ of units 18,18′ by drive means including tape-like members which engage whirls 24,24′ of such units. The aforesaid spindle driving means, and many other components of machine 10, are not shown in the drawings since illustration thereof is not necessary for an understanding of the spindle mounting means of the present invention.

Such spindle mounting means includes at least a first spindle mounting assembly 26 and a second spindle mounting assembly 26′ for respectively mounting spindle units 18,18′ in vibration-insulated relationship to the frame of machine 10, to the spindle units 18′,18 adjacent the opposite side of the machine, and to the other mounting assembly 26′,26. Preferably a plurality of assemblies 26 and assemblies 26′ are provided, with each assembly being in vibration-insulated relationship to the others and mounting only a limited number of the total spindle units 18,18′ on one side of machine 10. In accordance with such preferred arrangement, the machine 10 shown in FIGS. 1–3 is provided with separate assembly 26 and a separate assembly 26′ at each of the machine "bays," i.e., the longitudinal machine sections between adjacent ones of the transverse frame members 12,14. The four machine bays shown in FIG. 1 are respectively identified by the descriptions B-1,B-2,B-3 and B-X. Each of the assemblies 26,26′ respectively mounts the group of spindle units 18,18′, illustratively eight in number, within its associated machine bay and adjacent the respective first and second sides of machine 10. The spindle mounting assemblies 26,26′ associated with each bay of machine 10 may be identical to those associated with the single machine bay B-2 also shown in FIGS. 2–5, to which reference should now be made.

The assembly 26 shown in FIGS. 2–5 includes an elongate spindle supporting member 28 which extends in parallel, spaced adjacent relationship to the uppermost and outermost edge portion of rail 16 of the frame of machine 10. Member 28 has a generally rectangular cross-sectional shape, and possesses a length slightly less than the distance between the centers of the samsons 14 defining opposite longitudinal extremities of the machine bay B-2 with which assembly 26 is associated. More specifically, the length of spindle supporting member 28 is such that its opposite ends are spaced slightly from the confronting ends of the corresponding members 28 of the spindle mounting assemblies 26 at the immediately adjacent bays B-1,B-3 of machine 10. The eight spindle units 18 within machine bay B-2 are spaced equally along the length of member 28 and are secured thereto in any suitable manner: illustratively the bases 22 of units 18 project through bores (not shown) provided within member 28, and a clamping nut associated with each base 22 secures the associated spindle unit 18 to member 28. Stabilizing means in the form of at least one, and preferably and illustratively two, bar-like transverse stabilizing members 30 are rigidly secured to spindle supporting member 28. The outer end portions of members 30 underlie member 28, at locations thereon spaced from each other and equally from the opposite extremities of member 28, and are secured thereto as by means of bolts 32 (see FIG. 4). Stabilizing members 30 extend transversely inwardly from spindle supporting member 28, projecting freely through enlarged openings 34 (FIGS. 4 and 5) provided within frame rail 16, and then projecting therebeyond toward the rail 16′ adjacent the opposite side of machine 10. However, the length of members 30 is such that they terminate short of the opposite side of machine 10 and may, as shown in FIGS. 2 and 3, terminate short of the machine's longitudinal centerline.

Figure 4:
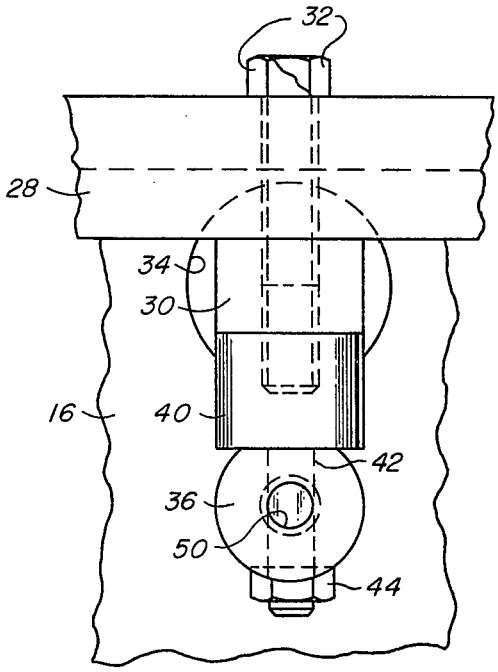
FIG. 4 is a fragmentary, enlarged side elevational view of components shown in FIGS. 2 and 3, as viewed in the direction of the arrows 4—4 of FIG. 3.
Figure 5:
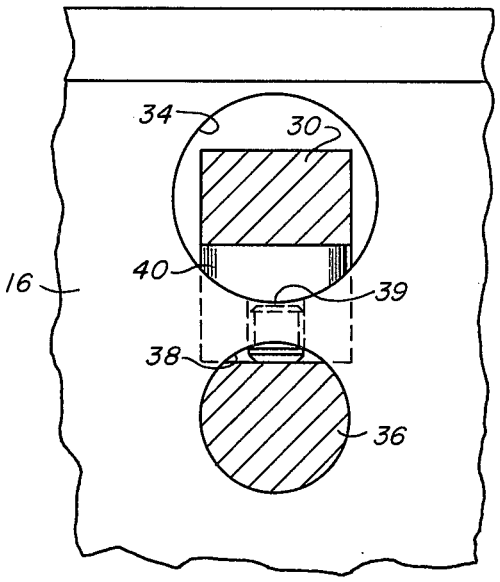
FIG. 5 is an enlarged fragmentary view, partially in vertical section and partially in side elevation, taken approximately along the line 5—5 of FIG. 3.
Figure 6:
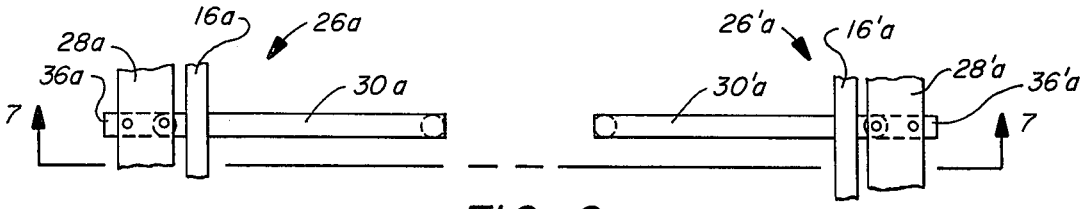
FIG. 6 is a fragmentary top plan view of another embodiment of spindle mounting assemblies in accordance with the invention.
Figure 7:
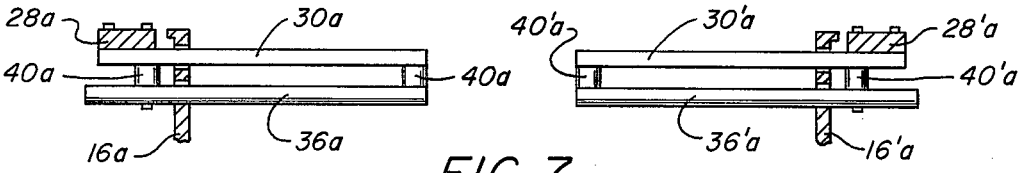
FIG. 7 is a view taken approximately along the line 7—7 of FIG. 6 and showing the assemblies thereof partially in vertical section and partially in elevation.

In addition to the components 12,14 previously described, the frame of machine 10 includes additional transverse frame members 36, there being one such member 36 extending transversely of machine 10 in parallel and closely-spaced underlying relationship to each stabilizing member 30 26. Each of the spindle mounting assemblies 26. frame member 36, which except for a flat upper surface possesses a generally circular cross-sectional shape (see FIGS. 4 and 5), projects at one end through a closely confining opening 38 provided within rail 16 below the opening 34 through which extends the stabilizing member 30 disposed thereabove. A set screw 39 (FIG. 5) rigidly but releasably interconnects member 36 and rail 16. At the opposite side of machine 10, the other end portion of member 36 similarly projects through and is connected to rail member 16'. Resilient vibration-damping means, in the form of a plurality of cylindrically-shaped damping elements 40 disposed between stabilizing members 30 and frame members 36, supportively interconnect spindle mounting assembly 26 and the frame of machine 10. Illustratively each assembly 26 is supported by four of the resilient elements 40, which may be of a known rubberous type sold under the designation FLEX-BOLT by Lord Manufacturing Company, a division of Lord Corporation of Erie, Pa. As is best shown in FIG. 4, one element 40 is disposed between the outer end portions of each stabilizing member 30 and transverse frame member 36 which underlie spindle supporting member 28 of assembly 26. One of the bolts 32 interconnecting the aforesaid members 28,30 is received within a threaded bore provided within the upper portion of such element 40, as is indicated in FIG. 4, and thus also interconnects members 30,40. A threaded stud 42, carried by and projecting downwardly from the lower end portion of element 40, extends through an aligned vertical bore provided within transverse frame member 36, and in cooperation with a nut 44 secures element 40 upon the flat upper surface of member 36. Another of the resilient elements 40 is similarly disposed between and connected to the opposite, inner-end portion of each stabilizing member 30 and that section of the transverse frame member 36 disposed immediately therebelow. The element 40 adjacent the inner end portion of stabilizing member 30 may be secured to it and to transverse frame member 36 by means of bolts, studs and the like (not shown) such as described previously in association with the element 40 adjacent the outer end portion of member 30. Alternatively, however, any of the elements 40 might be secured to either or both members 30,36 by other suitable means, such as by adhesive-bonding.

The assembly 26' which mounts the eight spindle units 18' which are adjacent the opposite side of machine 10 is constructed and mounted in the same manner as previously-described assembly 26, and the corresponding components are designated by the same reference numerals, with the addition of a prime designation, employed in the foregoing description of assembly 26.

By virtue of the above-described mounting arrangement, it will be appreciated that each eight-spindle group of the spindle units 18,18' is mounted by its associated assembly 26 or 26' in vibration-insulated relationship to the frame components of machine 10, to all other assemblies 26,26', and to all other of the spindle units, including both all of the spindle units adjacent the opposite side of machine 10 and all remaining spindle units which are adjacent the same side of machine 10 as the group of spindle units in question. The vibrations produced during operation of machine 10 by each eight-spindle group of units 18,18' are therefore impeded from possibly reinforcing the vibrations produced by ay other group of units 18,18', and the transmission of vibrations from any of the units 18,18' to frame and other massive components of machine 10 is minimized. While the vibrations emanating from each group of units 18,18' are transmitted to the associated assembly 26 or 26' supporting that group, the noise generated by each such assembly 26,26' under the impetus of the vibrations transmitted thereto is not excessive. That is due, firstly, to the relatively small mass and surface-area of each assembly 26,26'. It will be noted, in the foregoing connection, that the length of each transverse stabilizing member 30,30' of the assemblies need only be such as to impart such stability to the spindle mounting members 28,28' associated therewith as to insure that the eight spindle units 18,18' mounted thereby rotate about substantially fixed vertical axes during operation of machine 10. In most instances, the length of members 30,30' therefore can and will be less than one-half the width of machine 10. Secondly, since with the present mounting arrangement the spindle units 18,18' are separately mounted in discrete groups, each of which is independent of the other, the mounting assemblies 26,26' can be readily designed and constructed so as to avoid undesirable resonant vibration of their components at specific vibration frequencies. Thus, if it is determined that in a particular machine 10 the units 18,18' would cause undesirable resonant vibration in stabilizing members 30,30' if the same were of a particular length, such members can readily be constructed of a longer or shorter different length so as to avoid the aforesaid resonance problem. The same is true with respect to spindle supporting members 28,28', which similarly might be designed and constructed of a longer or shorter length than that shown and previously described, if necessary or desirable to avoid resonant vibration therein. Noise reduction therefore may be and preferably is achieved in a plurality of different ways: i.e., by minimizing the transmission of spindle-unit vibrations to all major frame components of machine 10; by negating possible reinforcement of the vibrations of one group of spindle units by the vibrations of any of the other groups of spindle units; and by permitting the individual spindle mounting assemblies to each be of a minimal size and mass and so constructed as to avoid resonance conditions therein.

In addition, the present invention also includes means cooperable with frame rails 16,16' for substantially enclosing the base components 22,22' of spindle units 18,18' and for thereby muffling to a significant extent the noise directly produced by bearings of such units. As is shown in FIGS. 1–3, the rail 16 on the first side of machine 10 includes a flange portion 17 formed integrally with and projecting laterally outwardly from its main body portion, intermediate the height of the latter. Flange 17 underlies the base components 22 of spindle units 18, and its outermost edge is shaped so as to receive and support the lower edge of a removale cover plate 46 which, when in position upon the frame of machine 10, extends substantially the full length of such frame in parallel spaced relationship to rail 16. At spaced locations along the length of cover plate 46, or along the aligned sections thereof if plate is formed in separate sections, the same is releasably secured to the outermost ends of transverse frame members 36 by means of bolts 48, which are receivable within threaded bores 50 (FIG. 4) provided within the aforesaid outer ends of members 36. When plate 46 is secured in place, the bolsters 22 of spindle units 18 are housed in a lateral direction between it and the vertical main body portion of rail 16, and are confined in a vertical direction between the rail flange 17 and the spindle support members 28 through which the base components 22 project. The noise produced during operation of machine 10 by the bearings within bolsters 22 is therefore muffled to significant extent. On the opposite side of machine 10, the bolsters 22' of spindle units 18' are similarly substantially enclosed by identical components, which are designated by the same reference numbers with the addition of a prime designation. On both sides of machine 10, the cover plates 46,46' are of course spaced from the adjacent spindle mounting members 28,28', so as to negate the possibility of spindle vibrations being transmitted during operation of machine 10 from the latter to plates 46,46' and thence to frame components of machine 10.

Various alternative embodiments of the present spindle mounting means are depicted in FIGS. 6–13, wherein components identical or similar to those previously described are identified by corresponding reference numberals with the addition of a letter suffix thereto.

In the previously-described FIGS. 1–5 embodiment, each transverse frame member 36 was so constructed as to extend completely across the width of machine 10. Apart from the other functions thereof, members 36 therefore imparted additional structural integrity to the frame of machine 10. If this added benefit should not be necessary or desired, the alternative construction shown in FIGS. 6 and 7 might be employed. In such alternative construction a transverse frame member **36*a* underlies each stabilizing member 30*a* of each assembly 26*a* supporting spindle units 18 adjacent the first side of machine 10, and a separate transverse frame member 36'*a* is provided beneath each transverse stabilizing member 30'*a* of each assembly 26'*a* supporting spindle units 18' adjacent the other side of machine 10. Transverse frame members 36*a*,36'*a* project laterally inwardly from the respective rails 16*a*,16'*a* to which the same are secured, and each illustratively terminates short of the axial center-line of machine 10. Each transverse frame member 36*a*,36'*a* and the transverse stabilizing member 30*a*,30'*a* directly thereabove are interconnected by a pair of the resilient elements 40*a*,40'*a* interposed between the adjacent opposite end portions thereof. Stabilizing members 30*a*,30'*a* and transverse frame members 36*a*,36'*a* may have a length different from that shown in FIGS. 6 and 7, but of course should not be made so short in length as to fail to adequately stabilize the spindle supporting members 28*a*,28'*a*** respectively associated therewith.

Figure 8:
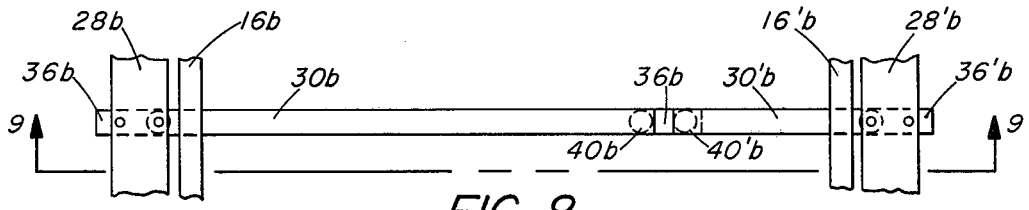
FIG. 8 is a fragmentary top plan view of another embodiment of spindle mounting assemblies in accordance with the invention.
Figure 9:
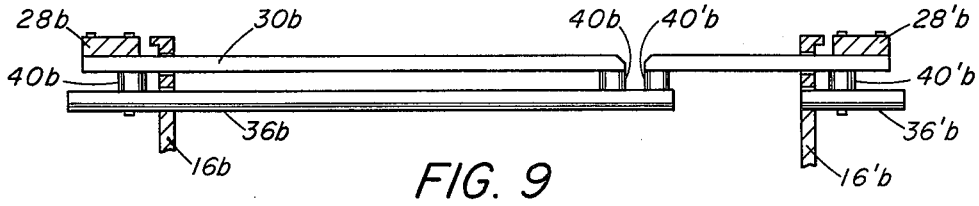
FIG. 9 is a view taken approximately along the line 9—9 of FIG. 8 and showing the assemblies thereof partially in vertical section and partially in elevation.

In the alternative embodiment shown in FIGS. 8 and 9, separate transverse frame members **36*b* and 36'*b* are similarly respectively secured to and carried by associated ones of the rails 16*b*,16'*b*. In contrast to the transverse frame members 36*a*,36'*a* of the above-discussed embodiment of FIGS. 6 and 7, however, the transverse frame members 36*b*,36'*b* of FIGS. 8 and 9 are of unequal length. The member 36'*b* carried by rail 16'*b* projects laterally outwardly therefrom in the same manner as the transverse frame members previously shown and described, but does not project inwardly therefrom to any appreciable extent. The transverse frame member 36*b* on the opposite side of machine 10 projects both outwardy from its associated rail 16, and also projects inwardly therefrom beyond the axial center of machine 10. Member 36*b* still terminates, however, short of and in spaced relation to the rail 16'*b* on the opposite side of machine 10. Frame member 36*b* and the stabilizing member 30*b* directly thereabove are interconnected in substantially the manner previously described by a pair of resilient elements 40*b* disposed therebetween and secured thereto. Additionally, transverse frame member 36*b* and the inner end portion of the stabilizing member 30'*b* extending inwardly from the opposite side of machine 10 are interconnected by the resilient element 40'*b* underlying the inner end portion of stabilizing member 30'*b*. The outer end portion of stabilizing member 30'*b* and transverse frame member 36'*b* are interconnected by a second resilient element 40'*b*** disposed therebetween.

Figure 10:
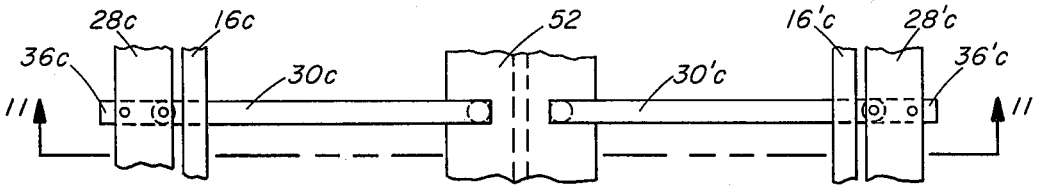
FIG. 10 is a top plan view of another embodiment of spindle mounting assemblies in accordance with the invention.
Figure 11:
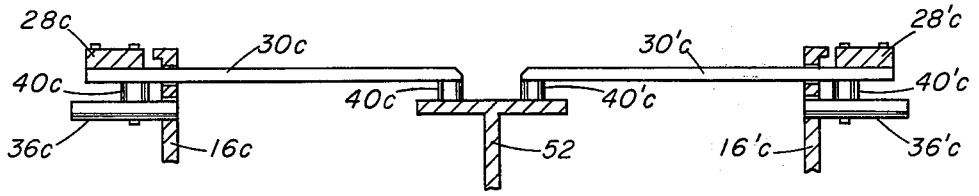
FIG. 11 is a view taken approximately along the line 11—11 of FIG. 10 and showing the assemblies thereof partially in vertical section and partially in elevation.

In the embodiment of FIGS. 10 and 11, the transverse frame members **36*c*,36'*c* are both of a foreshortened construction such as shown and described in connection with frame member 36'*b* of the FIGS. 8, 9 embodiment. An additional frame member 52, illustratively of generally T-shaped cross-sectional configuration is provided adjacent the axial center of machine 10. Member 52 may be of unitary construction, but might be formed in aligned sections. Member 52 extends throughout substantially the entire length of machine 10 and is rigidly connected, in any suitable manner, to frame components 12,14. The outer end portions of transverse stabilizing members 30*c*,30'*c* are respectively connected by resilient elements 40*c*,40'*c* to underlying transverse frame members 36*c*,36'*c*. However, the inner end portions of stabilizing members 30*c*,30'*c* are respectively connected, by resilient elements 40*c*,40'*c*, to central frame member 52. As in the previously described embodiments, the inner resilient elements 40*c*,40'*c* are shown underlying the responsive stabilizing members 30*c*,30'*c*, with their central axes extending substantially vertically. However, member 52 might be so positioned that elements 41*c*,41'*c* overlie, rather than underlie, the associated stabilizing members 30*c*,30'*c*, or might even be so constructed that the resilient elements 40*c*,40'*c* interconnecting members 30*c*,30'*c*** and a central frame member, have their axes extending substantially horizontally, rather than vertically.

Figure 12:
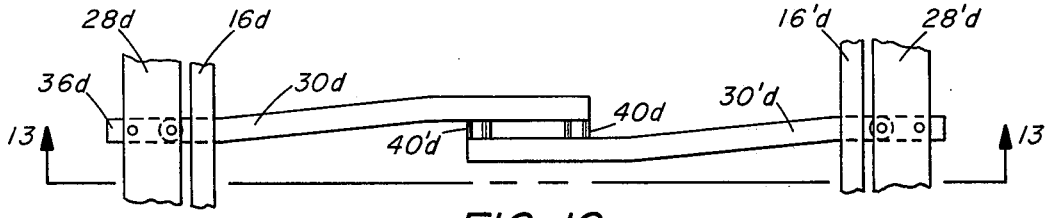
FIG. 12 is a top plan view of another embodiment of spindle mounting assemblies in accordance with the invention.
Figure 13:
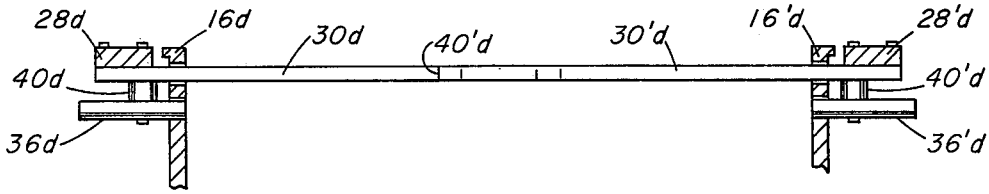
FIG. 13 is a view taken approximately along the line 13—13 of FIG. 12 and showing the assemblies thereof partially in vertical section and partially in elevation.

In the embodiment of FIGS. 12 and 13, the outer end portions of stabilizing members **30*d*,30'*d* are supportively connected in a manner such as previously described by elements 40*d*,40'*d* to short-length frame members 36*d*,36'*d*. The inner end portions of stabilizing members 30*d*,30'*d* are offset from their inner end portions and from each other, and adjacent the center of machine 10 extend in spaced and generally parallel overlapping relationship to one another. The resilient element 40*d* adjacent the outer end of stabilizing member 30*d* is secured to the adjacent confronting portion of stabilizing member 30'*d*. Similarly, the resilient element 40'*d* carried adjacent the outer end of stabilizing member 30'*d* is secured to the confronting adjacent portion of stabilizing member 30*d*. Since the inner end positions of members 30*d*,30'*d* are shown as being laterally offset from one another, the axes of the resilient element 40*d*,40'*d* therebetween extend generally horizontally, rather than vertically. It will be appreciated, hoever, that the inner end portions of stabilizing members 30*d*,30'*d* might be vertically, rather than laterally, offset relative to each other, in which event the axes of the interconnecting resilient elements 40***d*,40′*d* would extend substantially vertically rather than horizontally.

Although various preferred embodiments of the invention have been specifically shown and described, it is to be understood that this was for purposes of illustration only, and not for purposes of limitation, the scope of the invention being in accordance with the following claims.

That which is claimed is:

1. In a textile twisting machine having an elongate frame, and a plurality of spindle units adapted to be mounted in first and second rows adjacent first and second opposite sides of said elongate frame, the improvement comprising:

spindle mounting means for mounting said spindle units adjacent each side of said machine frame in vibration-insulated relationship to said machine frame and to said spindle units adjacent the other side of said machine frame, said spindle mounting means including first and second spindle mounting assemblies for respectively mounting said spindle units adjacent said first and second sides of said machine frame, each of said assemblies including an elongate member supporting a plurality of said spindle units adjacent the corresponding one of said sides of said machine frame and extending longitudinally of and generally parallel to said one of said sides of said machine frame, and at least one transverse stabilizing member connected adjacent its outer end to said elongate member and extending transversely therefrom inwardly toward, but terminating in spaced relationship to, another of said assemblies mounting a plurality of said spindle units adjacent the other of said sides of said machine frame;

and resilient vibration-damping means for mounting each of said assemblies upon said machine frame in vibration-insulated relationship to said frame and to the remainder of said assemblies and for thereby minimizing vibration transmission from said assemblies to each other and to said machine frame.

2. A machine as in claim 1, wherein said assemblies include a plurality of first assemblies each mounting an associated one of a plurality of longitudinally spaced groups of said spindle units adjacent said first side of said machine frame, and a plurality of second assemblies each mounting an associated one of a plurality of longitudinally spaced groups of said spindle units adjacent said second side of said machine frame.

3. A machine as in claim 1, wherein said resilient vibration-damping means comprises a plurality of resilient elements associated with each of said assemblies, at least two of said elements being supportively connected to each of said assemblies adjacent said elongate spindle supporting member thereof, and at least one other of said elements being supportively connected to each of said assemblies adjacent the inner end portion of said stabilizing member thereof and distal from the said spindle supporting member of any of said assemblies.

4. A machine as in claim 1, wherein each of said assemblies includes a plurality of said transverse stabilizing members each connected adjacent its outer end to said elongate spindle supporting member of the corresponding one of said assemblies, and each having its terminal inner end disposed intermediate the width of said machine frame in transversely spaced relationship to said elongate spindle supporting members of said assemblies.

5. A machine as in claim 4, wherein each of said stabilizing members has a length no greater than approximately one-half of the width of said machine frame.

6. A machine as in claim 5, wherein each of said stabilizing member has a length less than one-half of the width of said machine frame.

7. A machine as in claim 1, wherein said frame of said machine includes a plurality of transverse frame members extending in closely spaced and generally parallel relationship to said transverse stabilizing members of said assemblies, and wherein said resilient vibration-damping means includes resilient elements disposed between and interconnecting said transverse stabilizing members and said transverse frame members.

8. In a textile twisting machine having an elongate frame, and a plurality of spindle units adapted to be mounted in first and second rows adjacent first and second opposite sides of said elongate frame, the improvement comprising:

spindle mounting means for mounting longitudinally spaced groups of said spindle units adjacent each side of said machine frame in vibration-insulated relationship to said machine frame, to the groups of said spindle units adjacent the other side of said machine frame, and to the remaining groups of said spindle units adjacent the same side of said machine frame, said spindle mounting means including a plurality of first and a plurality of second spindle mounting assemblies for respectively mounting the groups of said spindle units adjacent said first and second sides of said machine frame, each of said assemblies including an elongate member supporting one of the groups of said spindle units adjacent the corresponding one of said sides of said machine frame and extending longitudinally of and generally parallel to said one of said sides of said machine frame, and a plurality of transverse stabilizing members each connected adjacent its outer end to said elongate spindle supporting member and extending transversely therefrom inwardly toward, but terminating in spaced relationship to, another of said assemblies mounting a group of said spindle units adjacent the other of said sides of said machine frame;

and resilient vibration-damping means for mounting each of said assemblies upon said machine frame in vibration-insulated relationship to said frame and to the remainder of said assemblies, and for thereby minimizing vibration transmission from said assemblies to each other and to said machine frame.

9. A machine as in claim 8, wherein said frame of said machine includes a plurality of transverse frame members extending in closely spaced and generally parallel relationship to said transverse stabilizing members of said assemblies, and wherein said resilient vibration-damping means includes resilient vibration-damping elements disposed between and interconnecting said transverse stabilizing members of said assemblies and said transverse frame members.

10. A machine as in claim 9, wherein said machine frame includes first and second elongate rails extending longitudinally along opposite first and second sides thereof, and wherein said transverse frame members are carried by and project outwardly from said rails.

11. A machine as in claim 10, wherein at least some of said transverse frame members each extend between and are carried by both of said rails.

12. A machine as in claim 10, wherein at least some of said transverse frame members are each carried by only an associated one of said rails, and the length thereof is less than the distance between said rails.

13. A machine as in claim 10, wherein at least some of said transverse frame members are each interconnected by at least one of said resilient elements to a transverse stabilizing member of one of said first assemblies and by another of said resilient elements to a transverse stabilizing member of one of said second assemblies.

14. A machine as in claim 11, wherein all of said transverse frame members are each carried by and extend between said rails, and wherein each of said transverse frame members is interconnected by two of said resilient elements to a transverse stabilizing member of one of said first assemblies and is interconnected by two other of said resilient elements to a transverse stabilizing member of one of said second assemblies.

15. A machine as in claim 14, wherein said two resilient elements interconnecting each of said transverse frame members and each one of said stabilizing members are respectively disposed adjacent opposite end portions of said one of said stabilizing members.

16. A machine as in claim 10, wherein at least some of said resilient elements interconnect adjacent outer end portions of said stabilizing members and said transverse frame members.

17. A machine as in claim 16, wherein each of said transverse frame members has a terminal inner end portion disposed between and in spaced relationship to said rails, and wherein other of said resilient elements interconnect adjacent inner end portions of said transverse frame members.

18. A machine as in claim 16, wherein said resilient vibration-damping means includes additional ones of said vibration-damping elements each interconnecting the inner end portion of one of said stabilizing members of one of said first assemblies with the inner end portion of one of said stabilizing members of one of said second assemblies.

19. A machine as in claim 16, wherein said machine frame further includes a central frame member extending substantially the full length and adjacent the center thereof, and wherein said resilient means includes additional ones of said vibration-damping resilient elements interconnecting the inner end portions of said transverse stabilizing members and said central frame member.

20. A machine as in claim 10, and further including first and second cover-plate members carried by respective ones of said rails and by said spindle mounting means and cooperable therewith for muffling noise produced during operation of said machine by said spindle units.

* * * * *

UNITED STATES PATENT OFFICE

CERTIFICATE OF CORRECTION

Patent No. 3,946,545 Dated March 30, 1976

Inventor(s) Lester W. Pray

It is certified that error appears in the above-identified patent and that said Letters Patent are hereby corrected as shown below:

Col. 5, lines 3 and 4, "30 26. Each of the spindle mounting assemblies 26." should read -- 30 of the spindle mounting assemblies 26. Each transverse --.
Col. 6, line 3, "ay" should read -- any --; line 60, "removale" should read -- removable --.
Col. 8, line 37, "responsive" should read -- respective --; line 66, "hoever" should read -- however --.

Signed and Sealed this eighth Day of June 1976

[SEAL]

Attest:

RUTH C. MASON
Attesting Officer

C. MARSHALL DANN
Commissioner of Patents and Trademarks